US005317296A

United States Patent [19]

Vermilyea et al.

[11] Patent Number: 5,317,296

[45] Date of Patent: May 31, 1994

[54] DEMOUNTABLE CONDUCTION COOLED CURRENT LEADS FOR REFRIGERATED SUPERCONDUCTING MAGNETS

[75] Inventors: Mark E. Vermilyea, Schenectady; Bizhan Dorri, Clifton Park, both of N.Y.

[73] Assignee: General Electric Company, Schenectady, N.Y.

[21] Appl. No.: 759,336

[22] Filed: Sep. 13, 1991

[51] Int. Cl.[5] ..... H01F 1/00

[52] U.S. Cl. ..... 335/216; 174/125.1

[58] Field of Search ..... 335/216; 174/125.1, 174/15.4, 15.5, 15.6

[56] References Cited

U.S. PATENT DOCUMENTS 4,295,111 10/1987 Wang ..... 335/256
4,394,634 7/1983 Vansant ..... 335/216
4,841,268 6/1989 Burnett et al. ..... 335/216
4,876,413 10/1989 Vermilyea ..... 174/15.4
5,093,645 3/1992 Dorri et al. ..... 335/216
5,166,776 11/1992 Dederer et al. ..... 505/1

*Primary Examiner*—Lincoln Donovan
*Attorney, Agent, or Firm*—James R. McDaniel; Paul R. Webb, II

[57] ABSTRACT

This invention relates to demountable conduction cooled current leads for refrigerated superconducting magnets. Such structures of this type generally either allow the warm section of the current lead to be thermally demounted from the magnet after the magnet is powered or both the cold and warm sections of the current leads to be thermally demounted from the magnet after the magnet is powered. In this manner, the heat load placed upon the cryocooler is signficantly reduced when the magnet is powered.

21 Claims, 3 Drawing Sheets

DEMOUNTABLE CONDUCTION COOLED CURRENT LEADS FOR REFRIGERATED SUPERCONDUCTING MAGNETS

CROSS REFERENCE TO A RELATED APPLICATION

This application is related to commonly assigned U.S. patent application Ser. No. 07/757,337 entitled "Refrigerated Superconducting MR Magnet With Gradient Coils".

BACKGROUND OF THE INVENTION

1. Field of the Invention

This invention relates to demountable conduction cooled current leads for refrigerated superconducting magents. Such structures of this type generally either allow the warm section of the current lead to be thermally demounted from the magnet after the magnet is powered and placed in persistent mode or both the cold and warm sections of the current leads to be thermally demounted from the magnet after the magnet is powered and placed in persistent mode. In this manner, the head load placed upon the cryocooler is significantly reduced relative to that with the leads connected after the magnet is powered and placed in persistent mode.

2. Description of the Related Art

The implementation of refrigerated magnet technology has the potential to revolutionize superconducting magnet design. Simplification of the cryostat by elimination of the liquid helium vessel and one thermal radiation shield, typically found in a conventional superconducting magnet as well as the elimination of helium refilling or liquefaction, are great advantages of this technology.

One limitation of the technology is the cooling capacity of the cryogenic refrigerator or cryocooler, which is used to cool the magnet cartridge and the thermal shield. Since the temperatures of the cryocooler's first and second stages are, usually, inversely proportional to the heat inputs thereto, it is necessary to maintain those heat inputs below the level at which the magnet and shield temperatures are within their operating ranges. For typically commercially available cryocoolers of the 5 kW size which is optimal for application to an MRI imaging magnet, the first and second stage temperatures vs. heat load may be represented by FIG. 1.

Since the heat loads for a typical magnet of the size required for an MRI scanner are about 33 W at the first stage and 2 W at the second, the shield and magnet operating temperatures are about 40 and 11.5K, respectively. Of these loads, the majority of the second stage load, and about half of the first stage load, can come from the conduction cooled leads. Such leads are required to power the main field windings because of the lack of any boil off helium vapor to cool them. Tables 1–4 below show typical heat loads for a 0.5 Tesla magnet and for a design with the gradient coils integrated into the cryostat as set forth in U.S. patent application Ser. No. 07/757,337. As can be seen, the leads represent a significant portion of the total heat leak, especially at the second stage.

TABLE 1

| First stage heat inputs for 0.5 Tesla refrigerated magnet | |
|---|---|
| Radiation | 14.3 |
| Residual gas cond. | 1.6 |
| Conduction | 4.4 |

TABLE 1-continued

| First stage heat inputs for 0.5 Tesla refrigerated magnet | |
|---|---|
| Leads | 13.2 |
| Total | 33.5 |

TABLE 2

| Second stage heat inputs for 0.5 Tesla refrigerated magnet | |
|---|---|
| Radiation | 0.044 |
| Residual gas cond. | 0.022 |
| Conduction | 0.13 |
| Leads | 2.0 |
| Total | 2.2 |

TABLE 3

| First stage heat inputs for magnet with integrated gradient coil | |
|---|---|
| Radiation | 8.0 |
| Residual gas cond. | 0.8 |
| Conduction | 6.1 |
| Leads | 22.5 |
| Generation | 26.5 |
| Total | 63.9 |

TABLE 4

| Second stage heat inputs for magnet with integrated gradient coil | |
|---|---|
| Radiation | 0.044 |
| Residual gas cond. | 0.022 |
| Conduction | 0.13 |
| Leads | 2.0 |
| Total | 2.2 |

While the shield temperature of 40K for the typical magnet is within an acceptable range, the magnet temperature of 11.5K is unsuitable for certain applications because of the limited temperature range of the noibium tin superconducting material usually employed in the field windings. Particularly, magnets which must produce a relatively high field in the bore (>1 T) have a concomitantly high field in the windings (>3 T). The need for some temperature margin, i,e. an operating temperature below the critical temperature, results in an unacceptably low current in a winding at 3 T. By allowing the magnet to operate at a temperature close to its critical value only during the ramping phase of its operation, when the lead heat leak is unavoidable, demountable leads allow a resonable temperature margin during steady state operation.

Another attractive design which is improved by this technology is the placement of the gradient coils inside of the vacuum vessel, so that they operate at the thermal shield temperature of about 40–50 K, generates much less than they would at room temperature, and make the complete magnet/gradient coil package much smaller. In this case, however, the additional head load at the cryocooler first stage from the gradient coil leads and the heat generated in the gradient coils during image sequences results in an unacceptably high first stage temperature or the need for a larger capacity cryocooler. This situation is avoided by use of demountable warm leads, which eliminates 13 of the 22 W of lead heating (the balance being the gradient coil leads, which must remain connected during operation).

The two designs described above are possible if the heat input represented by the conduction cooled leads can be eliminated during routine operation (i.e. after the magnet is ramped up) by the use of such demountable leads. For the high field magnets, the second stage main coil leads would have to be demountable, while for the gradient coil integrated magnet, the first stage leads would have to be demountable. Ideally, both would be designed to be demounted.

Fortunately, MR magnets are typically designed to be operated in a persistent mode, i.e. with a superconducting switch in parallel with the main windings which is heated to a temperature which causes it to be resistive during magnet ramping, and then allowing to cool to a superconducting temperature. The main winding current then flows in a persistent loop through the main windings and the switch, and the current leads may be demounted until the magnet must be depowered. This demountable lead technology is in common use on helium cooled magents.

The realization of a demountable conduction cooled lead is complicated somewhat by the requirement that the cryocooler cold head, which must be thermally attached to the magnet and thermal shield to remove the heat, must at the same time be mechanically decoupled from the magnet and thermal shield. This requirement stems from the vibration induced "motion artifacts" which will appear in images produced by a magnet if it is vibrating during a scan.

Another issue which must be addressed is that if the cryocooler is sized to maintain the magnet and/or thermal shield at the design temperature without the lead heat input(s), the effect of these heat input(s) during magnet ramping must be addressed. Typically, the thermal mass of the magnet cartridge and the thermal shield are sufficient to limit their temperature rises to acceptable levels during ramps of reasonable duration.

It is apparent from the above that there exists a need in the art for a current lead for a refrigerated superconducting magnet which eliminates the use of a liquid helium vessel, and which can be thermally decoupled from the first and possibly also the second stage of the cryocooler once the magnet has been placed in persistent mode. It is a purpose of this invention to fulfill this and other needs in the art in a manner more apparent to the skilled artisan once given the following disclosure.

SUMMARY OF THE INVENTION

Generally speaking, this invention fulfills these needs by providing a refrigerated superconducting magnet, comprising a magnet cartridge means, a thermal shield means located adjacent said magnet cartridge means, at least two refrigerator stage station means located adjacent said magnet cartidge means and said thermal shield means, a movable actuator means having first and second ends and located adjacent said stage station means, at least two connector means located adjacent said second end of said actuator means and capable of contacting one of said stage station means, and a current lead means which thermally and electrically connect said connector means and thermally and electrically connect one of said connector means with said magnet cartridge means.

In certain preferred embodiments, the actuator is movable by use of a threaded fastener and a reaction cap while the vacuum is maintained by use of a bellows. Also, the connectors include thermally efficient electrically insulating joints for connecting a current lead to a stage station. Finally, the connectors are constructed with a conical shape in order to provide a good thermal joint between the stage stations and the current leads.

In another further preferred embodiment, either the warm section of the current lead is capable of being repeatedly thermally demounted from the first stage station after the magnet is powered or both the warm and cold lead sections of the current leads are capable of being repeatedly thermally demounted from the first and second stage stations, respectively, after the magnet is powered which allows the magnet to operate at high fields.

The preferred cooling system for a refrigerated superconducting magnet, according to the present invention, offers the following advantages: excellent durability; good stability; excellent cooling characteristics; good economy; high strength for safety; and a reduced temperature due to reduced heat load on the cryocooler. In fact, in many of the preferred embodiments, these factors of durability, cooling characteristics and reduced temperature are optimized to an extent considerably higher than heretofore achieved in prior, known cooling systems for superconducting magnets.

BRIEF DESCRIPTION OF THE DRAWINGS

The above and other features of the present invention which will become more apparent as the description proceeds are best understood by considering the following detailed description in conjunction with the accompanying drawings wherein like characters represent like parts throughout the several views and in which.

DETAILED DESCRIPTION OF THE INVENTION

Figure 1:
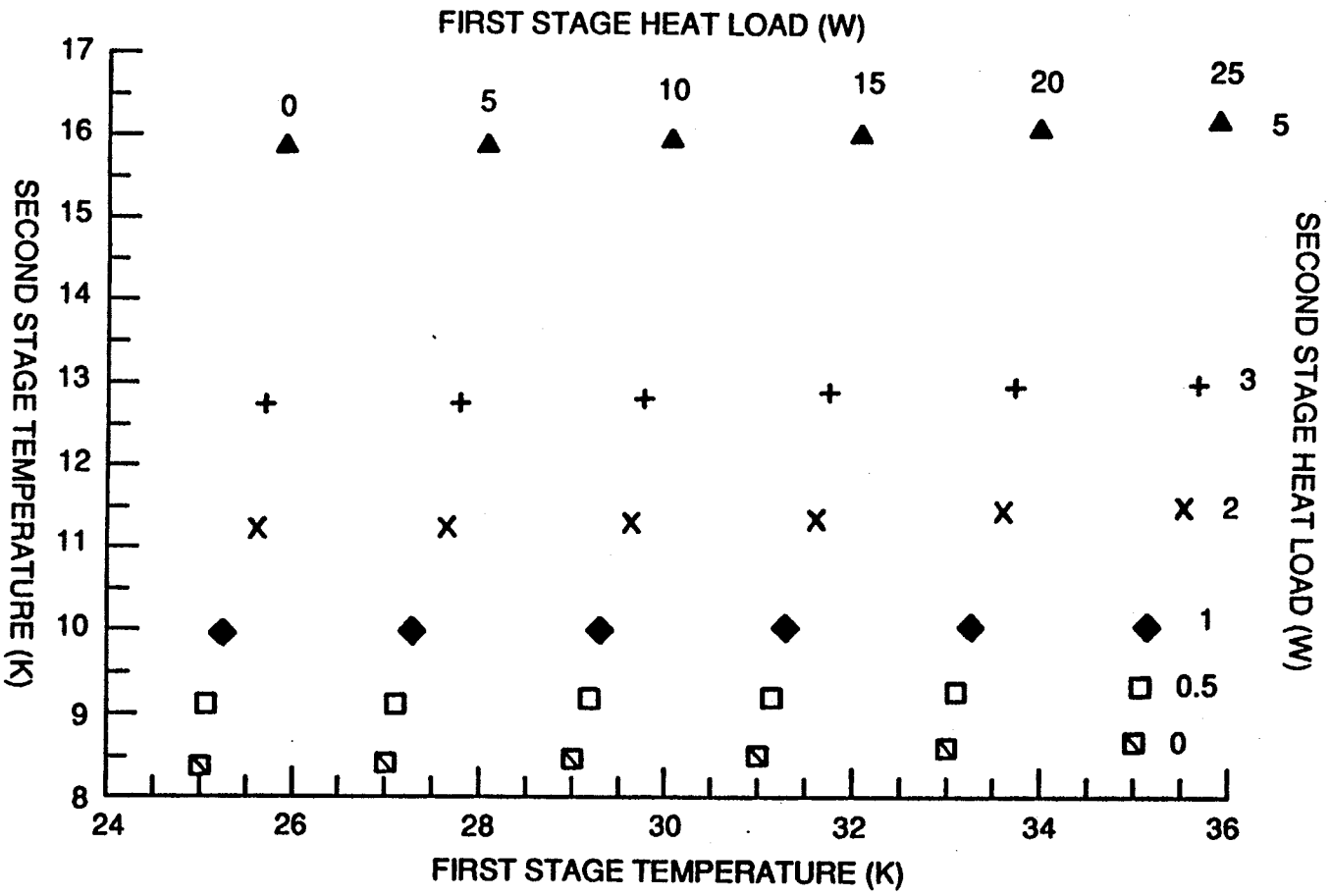
FIG. 1 is a graphical representation of a load map for a typical 5 kW cryocooler.

As discussed earlier in the description of the related art section, FIG. 1 is a graphical representation of a load map for a typical 5 KW cryocooler.

Figure 2:
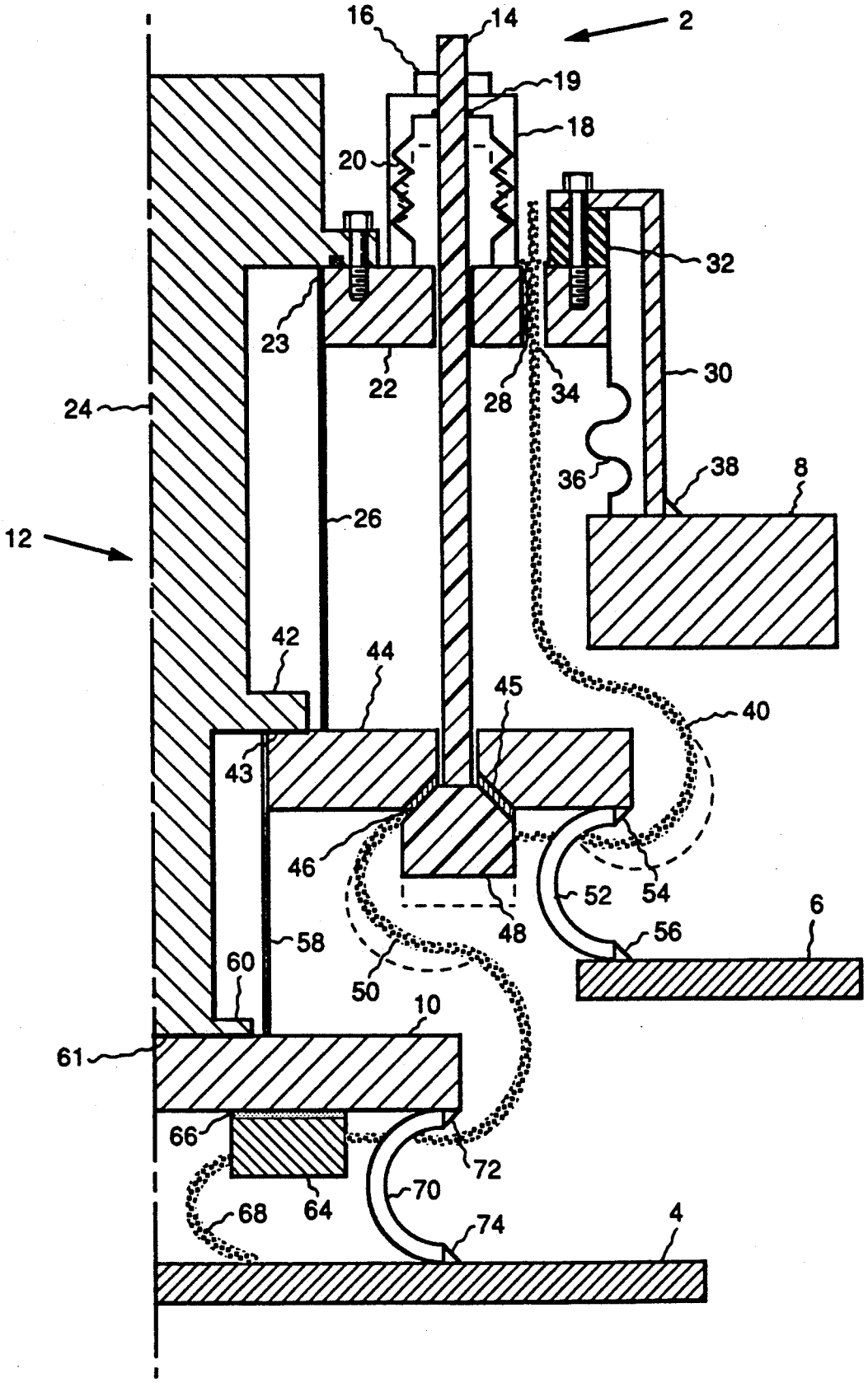
FIG. 2 is a schematic drawing of a demountable warm lead for a refrigerated superconducting magnet, according to the present invention.

With reference to FIG. 2, there is illustrated a demountable warm magnet lead 2. Magnet lead 2 includes, in part, a conventional magnet cartridge 4, conventional thermal shield 6, vacuum vessel 8, conventional first stage station 44, conventional second stage station 10 and cryocooler 12. Cartridge 4 and shield 6, typically, are maintained at temperatures of about 10K and 50K, respectively.

The demountable lead includes, in part, actuator rod 14 and a conventional fastener 16. Rod 14, preferably, is constructed of a fiberglass reinforced epoxy material. Fastener 16 mates with threads (no shown) located on rod 14. Rod 14 rests upon reaction cap 18. Cap 18, preferably, is constructed of non-magnetic stainless steel (NMSS). A conventional vacuum seal 19 is made between rod 14 and bellows 20 by conventional bonding techniques. Seal 19 contacts conventional bellows 20 in order to maintain the vacuum within bellows 20. Cap 18 and bellows 20 are rigidly attached to flange 22 by conventional welding techniques.

Flange 22, preferably, is constructed of NMSS and is rigidly attached to extension 23 of cryocooler shell 24 by a bolted joint with an o-ring seal. Also, flange 22, preferably, is maintained at room temperature (300K) and is rigidly attached to a conventional rubber busing 32 by a conventional adhesive or with a bolted connection. Shell 24, preferably, is constructed of NMSS. Warm sleeve 26 is rigidly attached to flange 22 and first stage station 44, preferably, by conventional welding and brazing techniques, respectively. Sleeve 26 is constructed of NMSS while first stage station 44 is constructed of copper.

One end of warm lead 40 which, preferably is constructed of copper is located in hole 34 in flange 22. Lead 40 contacts a hole (not shown) seal 28. Seal 28, preferably, is a vacuum tight, electrically insulating seal to maintain the vacuum while allowing the current lead to penetrate flange 22. Bushing 32 is rigidly attached to bracket 30 by a bolted joint. Bracket 30, preferably, is constructed of NMSS. Bracket 30 is rigidly attached to vacuum vessel 8 by conventional weldments 38. Vessel 8, preferably, is constructed of any suitable steel.

Station 44 is thermally coupled to extension 42 on shell 24 by a high thermal conductance joint using an indium gasket 43. Station 44 includes conical surface 45. Cold lead terminators 46 are retained to the surface 45 by the force of rod 14 and connector 48. Terminators 46, preferably, include an electrically insulating interface and are constructed the same as the thermal joints disclosed in U.S. Pat. No. 4,876,413 to M. A. Vermilyea entitled "Efficient Thermal Joints For Connecting Current Leads to a Cryocooler" and assigned to the same assignee as the present invention. Connector 48 which, preferably, is constructed of copper, contacts terminators 46. One end of connector 48 is conically shaped so that it can contact terminators 46 to create a good thermal and electrical connection. One end of warm lead 40 is electrically attached to connector 48 by conventional soldering techniques. Also, one end of cold lead 50 is rigidly attached to one terminator 46 by conventional soldering techniques.

Vibration isolator 52 is rigidly attached to station 44 by a conventional weldment 54. Also, isolator 52 is rigidly attached to shield 6 by a conventional weldment 56. Isolator 52, preferably, is constructed of laminated copper sheets.

Cold sleeve 58 which, preferably, is constructed of NMSS is rigidly attached to first stage station 44 and second stage station 10 by conventional brazing techniques. Station 10, preferably, is constructed of copper ad is thermally attached to extension 60 on shell 24 by a high thermal conductivity joint using an indium gasket 61. Cold lead busbar 64 which, preferably, is constructed of copper is rigidly attached using thermal joint 66 to station 10. Joint 66 is constructed in the same fashion as that between terminator 46 and fist stage station 44.

Cold lead 50 which, preferably, is constructed of copper is rigidly attached to busbar 64 by conventional soldering techniques. Magnet lead 68 which, preferably, is constructed of copper and a conventional superconductor is rigidly attached to busbar 64 by conventional soldering techniques. Vibration isolator 70 is rigidly attached to station 10 and magnet cartridge 4 by conventional weldments 72 and 74, respectively.

In operation of magnet 2, cold lead terminators 46 are thermally connected to first stage station 44 by the electrically insulating interface. The magnet current passes through connector 48 to cold lead terminator 46, down cold lead 50 to cold lead busbar 64, and from there to magnet cartridge 4 via magnet lead 68. The heat leak down cold lead 50 is carried from cold lead busbar 64 to second stage 10 of the cryocooler through an interface which is thermally conductive but electrically insulating.

Vibration isolation is accomplished by isolators 52, 70 which are typically laminated copper foils for minimum mechanical stiffness, and rubber bushing 32 at flange 22. Magnet lead 68 is made of copper wire and a conventional superconductor which are of sufficiently small diameter that it represents essentially no mechanical coupling of cryocooler assembly 12 to magnet cartridge 4. The warm and cold leads 40 and 50, respectively, like the cryocooler interface assembly, are mechanically decoupled from magnet cartridge 4 and thermal shield 6.

The temperature rise of cartridge 4 and thermal shield 6 during ramping will now be discussed. For the smallest likely 0.5 Tesla magnet design, of the size which would be realizable with the gradient coils integrated into the cryostat as set forth in U.S. patent application Ser. No. 07/759,387 filed Sep. 13, 1991, the volumes of the coil composite and the fiberglass reinforced epoxy coil form are about 10 and 40 liters, respectively. The volumetric specific heats of these two materials at 10 K are about 17 and 27 J/1-K, respectively yielding an effective heat capacity at 10 K of about 1230 J/K. With the 2 W lead heat leak, this allows 600 secs of ramping before the magnet temperature rises by 1 K.

When magnet 2 has been put in persistent mode and lead 40 is to be demounted, fastener 16 is loosened, and actuator rod 14 forced down to its dashed position until connector 48 is free from lead terminators 46. The warm lead 40, actuator rod 14 and connector 48 will then operate almost entirely at room temperature (300 K), although radiation cooling will reduce their temperatures near first stage station 44 slightly. The heat leak of the unpowered second stage lead 50 must still be removed by the cryocooler second stage 10 in this design. However, this design is intended for application to magnets where only the first stage heat input must be reduced, such as is possible when high temperature superconducting leads are used for the cold lead section or the gradient coil heat generation and leads skew the cooling requirements toward the first stage.

Figure 3:
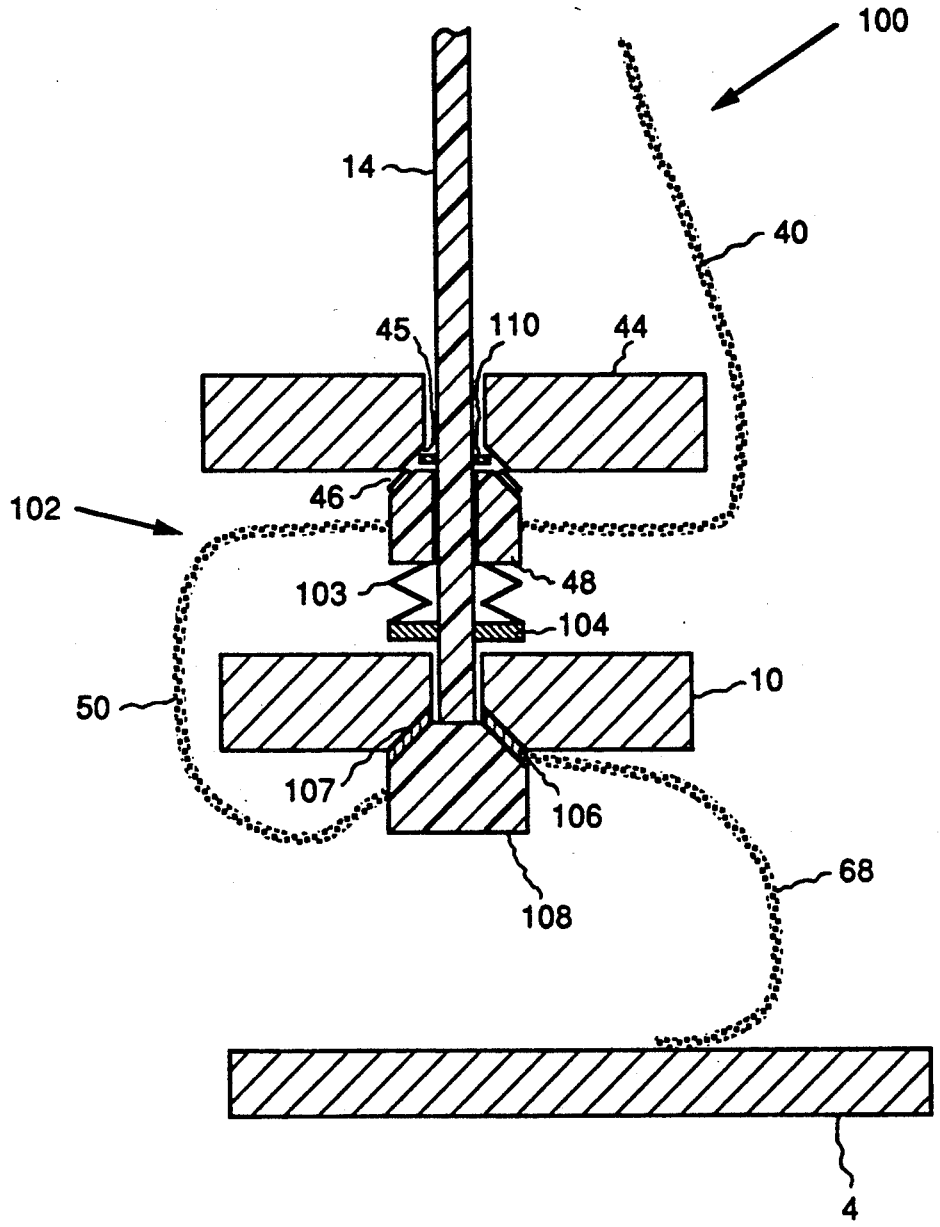
FIG. 3 is a schematic drawing of demountable warm and cold leads for a refrigerated superconducting magnet, according to the present invention.

With respect to FIG. 3, there is illustrated a demountable warm and cold lead magnet lead 100. Magnet lead 100 resembles magnet lead 2 (FIG. 2) in many respects except that magnet lead 100 includes a demountable cold lead. In particular, magnet lead 100 includes, in part, magnet cartridge 4, second stage station 10, actuator rod 14, warm lead 40, first stage station 44, opening 45, cold lead terminators 46, warm lead connector 48, cold lead 50, magnet lead 68 and connector assembly 102. Cartridge 4, rod 14, leads 40, 50 and 68, stations 10 and 44, opening 45, terminators 46 and connector 48 are constructed substantially the same as those found in FIG. 2.

Connector assembly 102 includes, in part, connector 48 which is rigidly attached to rod 14. Located below connector 48 are pressure plate 104 and conventional belleville washers 103. Plate 104, preferably, is constructed of NMSS. Washer 110 is rigidly attached to rod 14 near the top of connector 48 in order to facilitate the demounting of connector 48 from station 44 by breaking indium joint 46. Washer 110, preferably, is constructed of NMSS or fiberglass reinforced epoxy.

Cold lead 50 is rigidly attached to connector 48 and cold lead connector 108 by conventional soldering techniques. Connector 108 contacts magnet lead terminators 106 in station 10. Terminators 106 are rigidly attached to conical surface 107. Terminators 106 are constructed substantially the same as terminators 46. Connector 108, preferably, is constructed of copper. One end of connector 108 is conically shaped so that it can contact terminators 106 to create a good thermal connection. Magnet lead 68 is rigidly attached to terminators 106 by conventional soldering techniques.

FIG. 3 depicts a variation on the design of FIG. 2 wherein cold and warm leads 50 and 40, respectively are demounted as a single unit, this removing all lead heat loads on the cryocooler after magnet is placed in persistent mode. This design would be favored for applications where the second stage temperature with the lead heat load is too close to the conductor critical temperature, or where the cryocooler capacity cannot be easily increased for technical or economic reasons.

The operation of this design requires that actuator rod 14, which is connected at the warm end as shown in FIG. 2, be pulled up until the pressure between cold lead connector 108 and magnet lead terminators 106 is sufficient to make the thermal contact necessary. Pressure plate 104 is located on actuator rod 14 so that when cold lead connector 108 makes contact, belleville spring washers 103 are sufficiently deformed to create a similar pressure between warm connector 48 and first stage station 44. At this location, only a thermal connection is required, as the electrical connection here is permanent.

When the magnet is put in persistent mode, actuator rod 14 is lowered, then warm and cold lead connectors 48 and 108, respectively, are free from their stations 44 and 10, respectively. Magnet lead 68 is still thermally connected to second stage station 10, but the magnet temperature should be very close to that of the second stage station 10, so there is no heat leak associated with this lead. The warm and cold leads (40 and 50, respectively) their connectors (48 and 108, respectively) and actuator rod 14 will all operate at close to 300 K excepts for the radiational cooling of the cold ends.

Once given the above disclosure, many other features, modifications or improvements will become apparent to the skilled artisan. Such features, modifications or improvement are, therefore, considered to be apart of this invention, the scope of which is to be determined by the following claims.

What is claimed is:

1. A refrigerated superconducting magnet, said magnet comprising:

a magnet cartridge means;

a thermal shield means located adjacent said magnet cartridge means;

at least two refrigerator stage station means located adjacent said magnet cartridge means and said thermal shield means;

a movable actuator means having first and second ends and located adjacent said stage station means;

a connector means operatively connected to said second end of said actuator means and capable of contacting one of said stage station means; and a current lead means which thermally and electrically connects said connector means and thermally and electrically connects one of said connector means with said magnet cartridge means.

2. The magnet, according to claim 1, wherein one of said station means are further comprised of:

a conical opening; and a lead terminator means rigidly attached to said opening.

3. The magnet, according to claim 1, wherein said actuator means is constructed of a fiber reinforced epoxy material.

4. The magnet, according to claim 1, wherein said actuator means is further comprised of:

a fastener means threadedly engaging said first end of said actuator means;

a reaction cap means located adjacent said first end of said actuator means;

a flexible bellows means located substantially within said cap means; and a vacuum seal means which substantially contacts said bellows means and said first end of said actuator means.

5. The magnet, according to claim 1, wherein said actuator means is further comprised of:

a pressure plate means located along said actuator means and rigidly attached to said actuator means; and a washer means which contacts said pressure plate means and one of said connector means.

6. The magnet, according to claim 1, wherein said connector means are substantially constructed of copper.

7. The magnet, according to claim 1, wherein said connector means are further comprised of:

a warm connector having first and second ends.

8. The magnet, according to claim 7, wherein said first end of said warm lead connector is further comprised of:

a conical shape.

9. The magnet, according to claim 1, wherein said connector means is further comprised of:

a warm lead connector having first and second ends; and a cold lead connector having first and second ends.

10. The magnet, according to claim 9, wherein first ends of said warm lead connectors and said cold lead connectors are further comprised of:

a conical shape.

11. The magnet, according to claim 1, wherein said current leads means are constructed of copper.

12. The magnet, according to claim 1, wherein said current lead means are further comprised of:

a warm lead means;

a cold lead means; and a magnet lead means.

13. The magnet, according to claim 12, wherein said warm lead means is rigidly attached to one of said connector means.

14. The magnet, according to claim 12, wherein said cold lead means is rigidly attached to both of said connector means.

15. The magnet, according to claim 12, wherein said magnet lead means is rigidly attached to one of said connector means and said magnet cartridge means.

16. The magnet, according to claim 1, wherein said magnet is further comprised of:

first and second vibration isolation means.

17. The magnet, according to claim 16, wherein said first vibration isolation means is rigidly attached to one of said station means and said thermal shield means.

18. The magnet, according to claim 16, wherein said second vibration isolation means is rigidly attached to one of said station means and said magnet cartridge means.

19. A method for cooling a refrigerated superconducting magnet having a magnet cartridge means, a thermal shield means, at least two stage station means, a movable actuator means including a connector means, and a current lead means, said method comprised of the steps of:

contacting said connector means with at least one of said station means;

ramping said magnet until said magnet begins to run at a persistent mode;

conducting heat along said connector means and said current lead means;

operating said magnet at said persistent mode; and actuating said actuator means such that said connector means is located at a predetermined distance away from one of said station means.

20. The method, according to claim 19, wherein said step of actuating said actuator means is further comprised of the steps of:

manipulating a fastener means located on said actuator means;

traversing said actuator means away from one of said station means and;

flexing a spring means.

21. The magnet, according to claim 1, wherein said magnet is further comprised of:

a cold lead busbar operatively attached to the other of said stage station means.

* * * * *